US006513594B1

(12) United States Patent
McCalvin et al.

(10) Patent No.: US 6,513,594 B1
(45) Date of Patent: Feb. 4, 2003

(54) SUBSURFACE SAFETY VALVE

(75) Inventors: David E. McCalvin, Sugar Land, TX (US); Thomas M. Deaton, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/687,589

(22) Filed: Oct. 13, 2000

(51) Int. Cl.[7] ..... E21B 34/10

(52) U.S. Cl. ..... 166/320; 166/375; 166/332.3; 166/332.1

(58) Field of Search ..... 166/374, 375, 166/332.8, 319, 320, 324, 321, 332.1, 332.4, 72

(56) References Cited

U.S. PATENT DOCUMENTS

| | | | | |
|---|---|---|---|---|
| 3,071,151 A | | 1/1963 | Sizer | |
| 3,782,461 A | | 1/1974 | Watkins | |
| 4,069,871 A | | 1/1978 | Page, Jr. | |
| 4,144,937 A | | 3/1979 | Jackson et al. | |
| 4,161,219 A | | 7/1979 | Pringle | |
| 4,252,197 A | | 2/1981 | Pringle | |
| 4,373,587 A | | 2/1983 | Pringle | |
| 4,503,913 A | | 3/1985 | Carmody | |
| 4,527,631 A | | 7/1985 | Vazquez | |
| 4,569,398 A | | 2/1986 | Pringle | |
| 4,621,695 A | * | 11/1986 | Pringle | 166/321 |
| 4,660,646 A | | 4/1987 | Blizzard | |
| 4,854,387 A | | 8/1989 | Pringle | |
| 4,976,317 A | | 12/1990 | Leismer | |
| 5,310,004 A | | 5/1994 | Leismer | |
| 5,564,501 A | | 10/1996 | Strattan et al. | |
| 5,906,220 A | | 5/1999 | Thompson | |
| 5,947,206 A | | 9/1999 | McCalvin et al. | |
| 6,003,605 A | * | 12/1999 | Dickson et al. | 166/375 |
| 6,079,497 A | | 6/2000 | Johnston et al. | |
| 6,109,351 A | | 8/2000 | Beall | |
| 6,109,357 A | | 8/2000 | Zimmerman | |
| 6,173,785 B1 | | 1/2001 | Adams et al. | |
| 6,237,693 B1 | * | 5/2001 | Deaton | 166/375 |
| 6,302,210 B1 | * | 10/2001 | Crow et al. | 166/324 |

* cited by examiner

*Primary Examiner*—David Bagnell
*Assistant Examiner*—Jennifer R. Dougherty
(74) *Attorney, Agent, or Firm*—Polasek, Quisenberry & Errington, L.L.P.; Jeffrey E. Griffin; Brigitte L. Jeffery

(57) ABSTRACT

In a broad aspect, the invention may include a subsurface safety valve for controlling a fluid flow through a well conduit. The valve may include a housing that has a bore and is disposed within an annulus defined by the space between the well conduit and the housing. The valve may also have a valve closure member that is movable between an open position and a closed position, and adapted to restrict the fluid flow through the bore when in the closed position. The valve may also include a flow tube that is moveably disposed within the housing and adapted to shift the valve closure member between its open and closed positions. The valve may also include a piston that is moveably disposed within a cylinder in the housing and in mechanical communication with the flow tube. The piston may have a first seal disposed adjacent an upper end of the piston, a second seal disposed adjacent a lower end of the piston, and a third seal disposed between the first and second seals. The valve may also have a failsafe passageway in fluid communication with a balance pressure line and a portion of the piston between the first and third seals. The invention may also include a detachable piston arrangement that is balanced to the annulus or the surface.

31 Claims, 5 Drawing Sheets

SUBSURFACE SAFETY VALVE

BACKGROUND OF THE INVENTION

1. Field of the Invention The present invention relates to subsurface well equipment and, more particularly, to a subsurface safety valve.

2. Description of the Related Art

The use of subsurface safety valves in oil and gas wells is well known. U.S. Pat. No. 4,660,646 to Blizzard, which is fully incorporated herein by reference, describes the use of a "flapper" type valve disposed within the well bore which is opened and closed with a flow tube, generally a cylindrical tube which moves telescopically within the well bore. The Blizzard flow tube is actuated using a piston and cylinder assembly. One of the piston or cylinder is attached to the flow tube, and when hydraulic pressure is applied to the piston, the piston moves down as does the flow tube, thereby actuating the safety valve to an open position.

It is also well known that the fluid column acting on the piston and cylinder assembly to open the subsurface safety valve applies ever greater pressure the deeper the piston and cylinder assembly is set into the earth. Therefore, the force required to lift the flow tube, and close the valve, increases accordingly. Generally, spring force and sometimes hydraulic pressure is used to lift the flow tube and close the valve. Occasionally, the piston and cylinder assembly used to lift the flow tube fails due to seal wear or other well known mechanical failure. In the case of such a mechanical failure, if the aforementioned spring is not strong enough to overcome the force applied by the fluid column, the valve will fail in the open position. A failure in the open position is generally undesirable as being unsafe, and operationally inefficient. As such, various techniques have been employed to ensure that in the event of a failure, the valve will fail in the closed position.

The present invention is directed to a subsurface safety valve that, in the event of a failure, fails in the closed position.

SUMMARY OF THE INVENTION

The present invention has been contemplated to meet the above described needs. In a broad aspect, the invention may include a subsurface safety valve for controlling a fluid flow through a well conduit comprising: a housing having a bore and disposed within an annulus defined by the space between the well conduit and the housing; a valve closure member movable between an open position and a closed position, and adapted to restrict the fluid flow through the bore when in the closed position; a flow tube moveably disposed within the housing and adapted to shift the valve closure member between its open and closed positions; a piston assembly including a piston member in sliding relationship with a cylinder, the piston member in mechanical communication with the flow tube, the piston member having a first seal, a second seal, and a third seal, each seal sealing against the cylinder, and the third seal disposed between the first and second seals; and a failsafe passageway in fluid communication with a balance pressure line and a portion of the piston member between the first and second seals. Another feature of this aspect of the present invention may be that the failsafe passageway is in fluid communication with the portion of the piston member between the first and third seals; and the piston member is in mechanical communication with the flow tube between the second and third seals. Another feature of this aspect of the present invention may be that the failsafe passageway is in fluid communication with the portion of the piston member between the second and third seals; and the piston member is in mechanical communication with the flow tube between the first and third seals. Another feature of this aspect of the present invention may be that the balance pressure line is in fluid communication with the annulus. Another feature of this aspect of the present invention may be that the balance pressure line includes a filter. Another feature of this aspect of the present invention may be that the balance pressure line is in fluid communication with a source of pressurized fluid at the earth's surface. Another feature of this aspect of the present invention may be that the piston member is a rod piston. Another feature of this aspect of the present invention may be that the piston assembly includes a disengageable piston member. Another feature of this aspect of the present invention may be that the disengageable piston member is in mechanical communication with the piston member. Another feature of this aspect of the present invention may be that the disengageable piston member is in hydraulic communication with the piston member. Another feature of this aspect of the present invention may be that the balance pressure line is in fluid communication with the annulus. Another feature of this aspect of the present invention may be that the balance pressure line is in fluid communication with a source of pressurized fluid at the earth's surface. Another feature of this aspect of the present invention may be that a first end of the piston member is in fluid communication with a control pressure line and a second end of the piston member is in fluid communication with the balance pressure line. Another feature of this aspect of the present invention may be that the invention may further include a spring member adapted to force the flow tube toward its first position.

In another aspect, the invention may be a subsurface safety valve for controlling a fluid flow through a well conduit comprising: a housing having a bore and disposed within an annulus defined by the space between the well conduit and the housing; a valve closure member movable between an open position and a closed position, and adapted to restrict the fluid flow through the bore when in the closed position; a flow tube moveably disposed within the housing and adapted to shift the valve closure member between its open and closed positions; and a piston assembly having a piston member and a disengageable piston member, the piston member being in fluid communication with a control pressure source and in mechanical communication with the flow tube, the disengageable piston member being adapted to cooperate with the piston member to selectively cause the flow tube to shift the valve closure member to its closed position, at least one of the piston member and disengageable member being in fluid communication with a balance pressure line, the balance pressure line being in fluid communication with the annulus. Another feature of this aspect of the present invention may be that the balance pressure line includes a filter. Another feature of this aspect of the present invention may be that the invention may further include a spring member adapted to force the flow tube toward its first position. Another feature of this aspect of the present invention may be that the piston assembly is a detachable piston assembly disposed within a cylinder and in mechanical communication with the flow tube, the piston assembly having a lower piston member and an upper piston member, one end of one of the upper and lower piston members being in fluid communication with the control pressure source, and one end of the other of the upper and lower piston members being in fluid communication with the balance pressure line.

Another feature of this aspect of the present invention may be that each of the upper and lower piston members includes an internal passageway, the valve further including a piston rod having a piston rod valve member, disposed within the internal passageways of the upper and lower piston members and being detachably connected to the lower piston member. Another feature of this aspect of the present invention may be that invention may further include a first seal disposed about the upper piston member, a second seal disposed about the lower piston member, a third seal disposed about the lower piston member at a location between the first and second seals, and a failsafe passageway in fluid communication with the balance pressure line and portions of the upper and lower pistons located between the first and third seals. Another feature of this aspect of the present invention may be that the disengageable piston member is in mechanical communication with the piston member. Another feature of this aspect of the present invention may be that the disengageable piston member is in hydraulic communication with the piston member. Another feature of this aspect of the present invention may be that the piston member includes a first seal, a second seal, and a third seal, the third seal disposed between the first and second seals; and a failsafe passageway in fluid communication with a balance pressure line and a portion of the piston member between the first and second seals.

In yet another aspect, the present invention may be a subsurface safety valve for controlling a fluid flow through a well conduit comprising: a housing having a bore and disposed within an annulus defined by the space between the well conduit and the housing; a valve closure member movable between an open position and a closed position, and adapted to restrict the fluid flow through the bore when in the closed position; a flow tube moveably disposed within the housing and adapted to shift the valve closure member between its open and closed positions; and a piston assembly having a piston member and a disengageable piston member, the piston member being in fluid communication with a control pressure source and in mechanical communication with the flow tube, the disengageable piston member being adapted to cooperate with the piston member to selectively cause the flow tube to shift the valve closure member to its closed position, at least one of the piston member and disengageable member being in fluid communication with a balance pressure line, the balance pressure line being in fluid communication with a source of pressurized fluid at the earth's surface. Another feature of this aspect of the present invention may be that the valve may further include a spring member adapted to force the flow tube toward its first position. Another feature of this aspect of the present invention may be that the piston assembly is a detachable piston assembly disposed within a cylinder and in mechanical communication with the flow tube, the piston assembly having a lower piston member and an upper piston member, one end of one of the upper and lower piston members being in fluid communication with the control pressure source, and one end of the other of the upper and lower piston members being in fluid communication with the balance pressure line. Another feature of this aspect of the present invention may be that each of the upper and lower piston members includes an internal passageway, the valve further including a piston rod having a piston rod valve member, disposed within the internal passageways of the upper and lower piston members and being detachably connected to the lower piston member. Another feature of this aspect of the present invention may be that the valve may further include a first seal disposed about the upper piston member, a second seal disposed about the lower piston member, a third seal disposed about the lower piston member at a location between the first and second seals, and a failsafe passageway in fluid communication with the balance pressure line and portions of the upper and lower pistons located between the first and third seals. Another feature of this aspect of the present invention may be that the disengageable piston member is in mechanical communication with the piston member. Another feature of this aspect of the present invention may be that the disengageable piston member is in hydraulic communication with the piston member. Another feature of this aspect of the present invention may be that the piston member includes a first seal, a second seal, and a third seal, the third seal disposed between the first and second seals; and a failsafe passageway in fluid communication with a balance pressure line and a portion of the piston member between the first and second seals.

BRIEF DESCRIPTION OF THE DRAWINGS

Other features and advantages of the present invention will become more fully apparent from the following detailed description, appended claims, and the accompanying drawings in which:

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

For purposes of this description, the terms "upper," "lower," "up," "down," "uphole," and "downhole" are relative terms to indicate position and direction of movement in easily recognized terms. Usually these terms are relative to a line drawn perpendicularly downward from the center of the borehole at the earth's surface, and would be appropriate for use in straight, relatively vertical wellbores. However, when the wellbore is highly deviated, such as from about horizontal to about 60 degrees from vertical, or if there are multiple laterals, these usually comfortable terms to persons skilled in the art may not make sense. Use of these terms are for ease of understanding as an indication to what relative position or movement would be if the well were vertical, and should not be construed to limit the scope of the invention.

Figure 1:
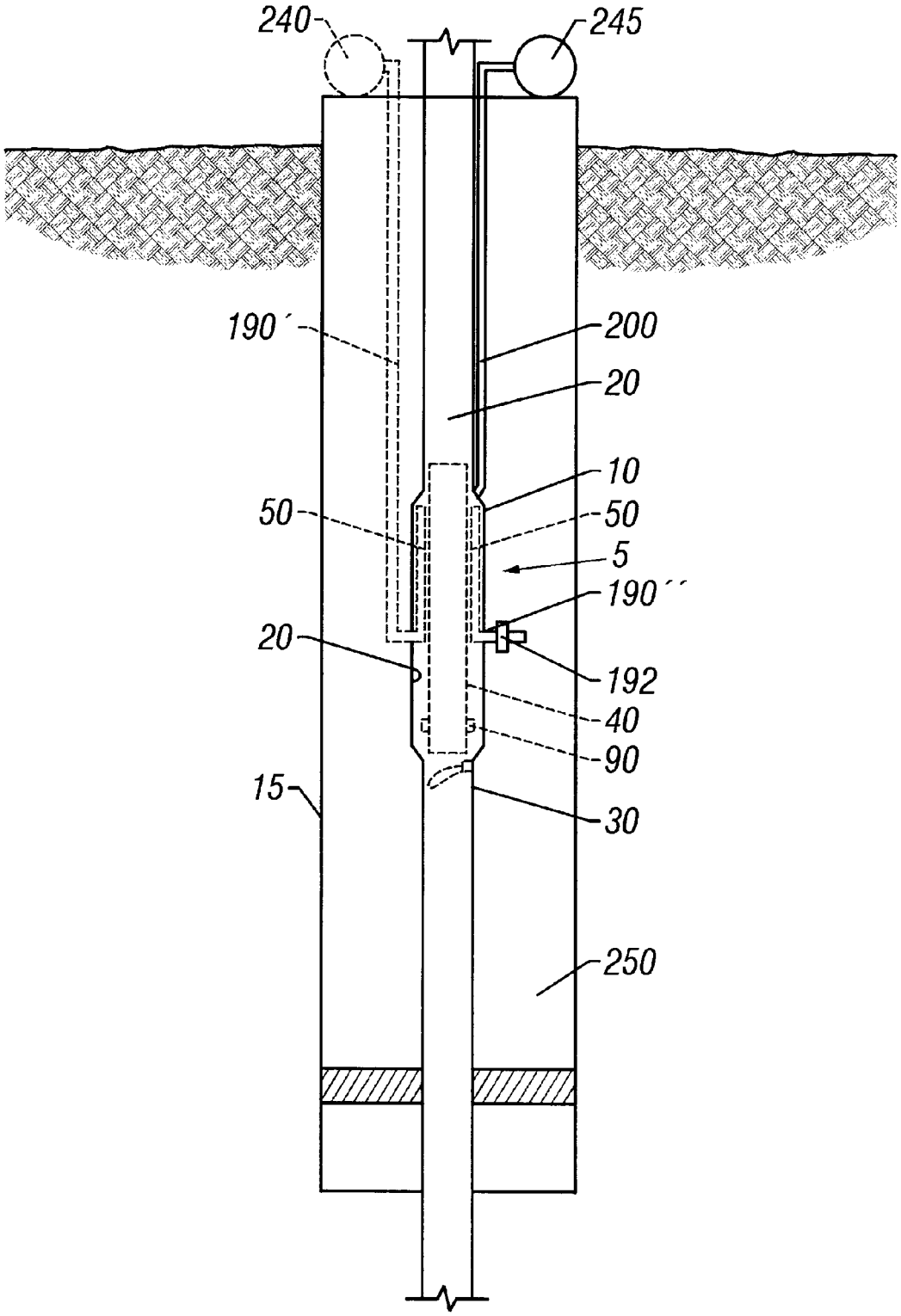
FIG. 1 illustrates a longitudinal cross-sectional view of a subsurface safety valve having one balance line to the annulus and one to the surface according to the present invention.

Referring to the drawings in detail, wherein like numerals denote identical elements throughout the several views, it can be seen with reference to FIG. 1 that, in one broad aspect, the subsurface safety valve 5 includes a housing 10 with a bore 20 through which the fluids (generally oil, gas or both) produced from the well flow to the surface. The space between the housing 10 and the well conduit 15 defines an annular volume, hereinafter referred to as the annulus 250. It is occasionally desirable to cease the flow of fluids through the bore, and so the present invention includes a valve closure member 30, shown in FIG. 1 as a flapper type valve, though various well known valve configurations may be employed. The valve closure member 30, whether of the flapper type or some other type, may also include a pressure-equalizing mechanism. The valve closure member 30 is shown in a partially open position for illustrative purposes only to show the valve closure member 30 more clearly. As will be explained in more detail later, the valve closure member 30 may be mechanically biased such that absent any other force, it remains in a closed position and blocks the passage of fluid through bore 20.

Figure 3A:
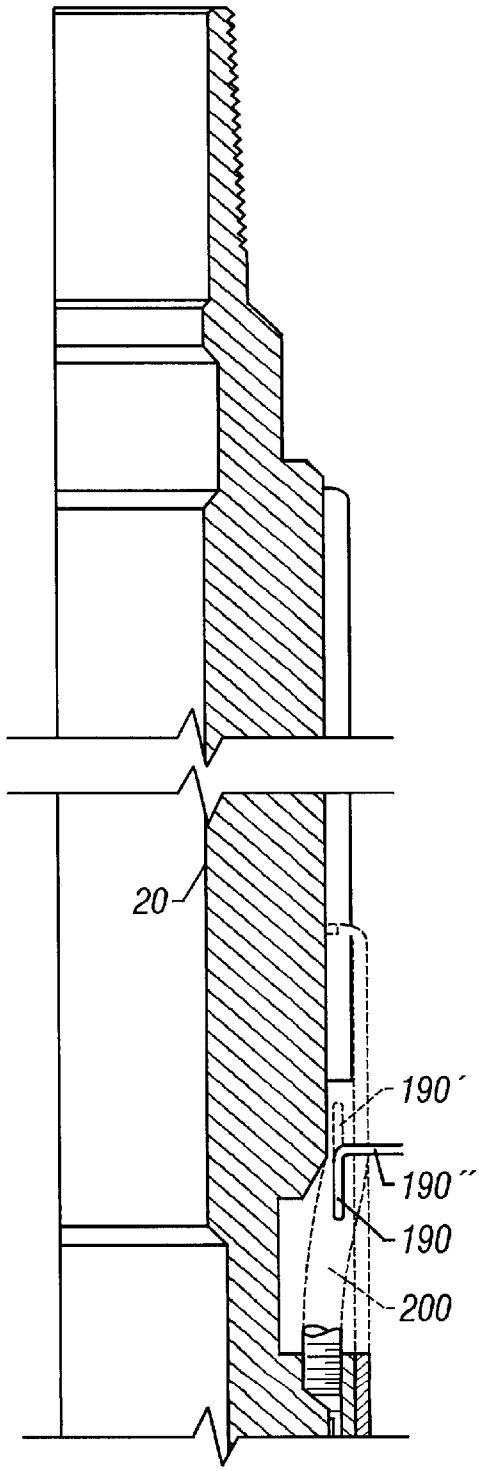
FIGS. 3A–3D illustrate a longitudinal cross-sectional view of a first embodiment of a piston and cylinder assembly with a disengageable piston member and a failsafe passageway.
Figure 3B:
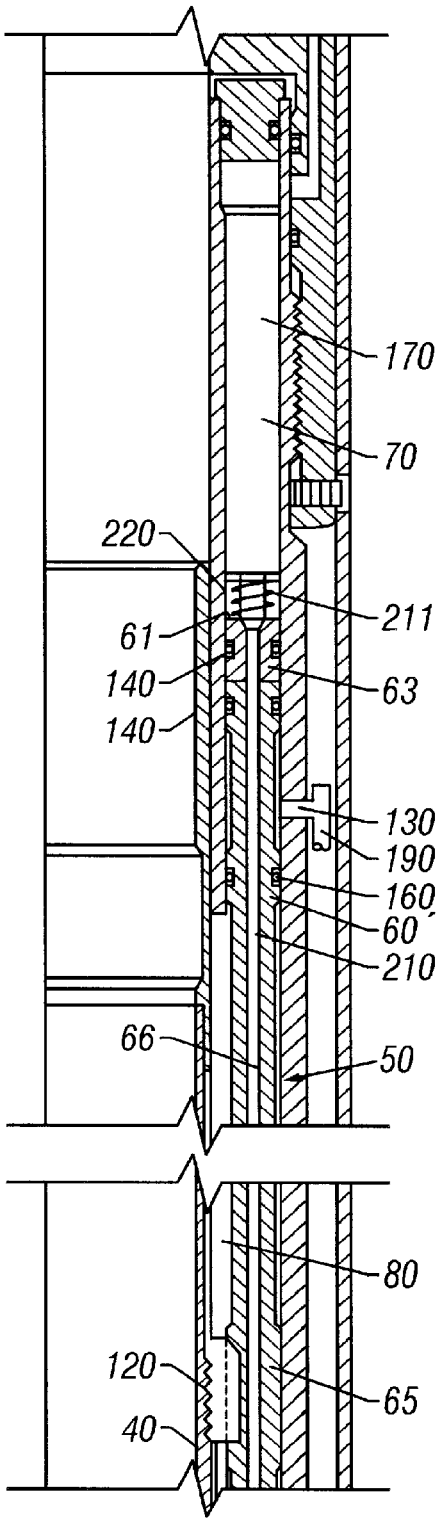

Opening and closing of the valve closure member 30 is usually accomplished by actuating a flow tube 40. Flow tube 40 is preferably a tubular sleeve which resides in bore 20 and generally moves telescopically up and down in the bore 20. When flow tube 40 is moved downward it contacts valve closure member 30 moving valve closure member 30 out of the fluid flow path in the bore 20. In the case of a flapper-type valve closure member 30, the valve closure member 30 pivots about pin 100 as seen in FIG. 3D. When flow tube 40 moves upward, it no longer contacts valve closure member 30, and valve closure member 30 again blocks the fluid flow path in bore 20, thereby closing the subsurface safety valve 5. Valve closure member 30 is preferably spring loaded, as with spring 110, such that without the flow tube 40 biasing the valve closure member 30 out of the fluid flow path in bore 20, the valve closure member 30 blocks the fluid flow path in bore 20, and subsurface safety valve 5 remains closed. The valve 5 may also include a lock out sleeve for locking the flow tube in its open position.

Figure 2:
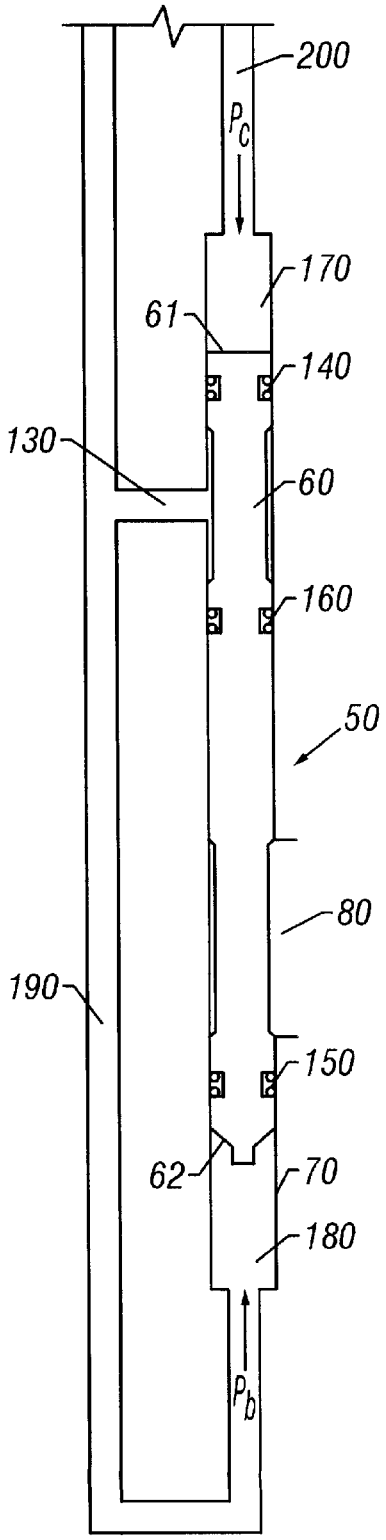
FIG. 2 illustrates a longitudinal cross-sectional view of one embodiment of a piston and cylinder assembly with a failsafe passageway according to the present invention.

According to the present invention, the flow tube 40 may be actuated, i.e. moved telescopically within the bore 20, by a piston and cylinder assembly 50. One embodiment of the piston and cylinder assembly 50 is best seen in FIG. 2. The piston and cylinder assembly 50 preferably includes at least one piston 60 which moves within cylinder 70 (see FIG. 3B), but it may also include at least one cylinder that slides in relation to a stationary piston (not shown). In a specific embodiment, the piston 60 may be a rod piston, as shown. The cylinder 70 may be disposed within the housing 10 as shown in FIG. 3B. Piston 60 preferably is mechanically connected to flow tube 40 by conventional means at an opening 80 in the cylinder 70. One example of such a mechanical connection is shown in FIG. 3B as threaded connection 120. Piston 60 is therefore normally in fluid communication with the bore 20 at opening 80. In the embodiment shown in FIG. 2, piston 60 is preferably forced in a downward direction by control fluid pressure denoted by arrow $P_c$. Control pressure $P_c$ may be supplied in a variety of ways which are well known. For example, a hydraulic pump located at the earth's surface near the wellhead could be used. Such a hydraulic pump is shown schematically in FIG. 1 as pump 245. The control pressure $P_c$ may be communicated from the pump 245 to the valve 5 via a control pressure line 200. Piston 60 is also preferably forced in an upward direction by balance fluid pressure denoted by arrow $P_b$. As more fully explained below, balance fluid pressure $P_b$ may be communicated to the valve 5 via a balance line 190. As shown in FIG. 1, the invention may include balance line 190' connected between the valve 5 and a hydraulic pump 240 at the earth's surface. Alternatively, the invention may include a balance line 190" that establishes fluid communication between the annulus 250 and the piston 60.

In this manner, neglecting friction, when the sum of the force exerted by control fluid pressure $P_c$ plus the weight of the piston 60 plus the weight of flow tube 40 is greater than the force exerted by balance fluid pressure $P_b$, the piston 60 moves in a downward direction. Accordingly, when piston 60 moves in a downward direction, so does flow tube 40 by virtue of the aforementioned mechanical connection 120 between flow tube 40 and piston 60, and the valve closure member 30 moves into an open position thereby allowing fluid flow through bore 20. On the other hand, when the force exerted by control fluid pressure $P_c$ plus the weight of the piston 60 plus the weight of flow tube 40 is less than balance fluid pressure $P_b$, the piston 60 generally moves in an upward direction and the valve closure member 30 moves to a closed position, thereby restricting the flow of fluid through bore 20. A spring 90 (FIG. 3D) in mechanical communication with housing 10 and flow tube 40 may also be employed to apply an upward force to flow tube 40. In such a case, in order that the valve 5 come to a closed position, neglecting friction, the sum of the force exerted by spring 90 and the force exerted by balance pressure $P_b$ must be greater than the force exerted by control pressure $P_c$ plus the weight of the piston 60 plus the weight of flow tube 40. Furthermore, if balance pressure $P_b$ is equal to control pressure $P_c$ then the force exerted by spring 90 will lift flow tube 40 thereby closing subsurface safety valve 5, provided that the spring is strong enough to lift the weight of piston 60 and control tube 40.

It will be noted that, as with all mechanical devices, the subsurface safety valve 5 may be subject to mechanical failure. It is desirable, in the event of a failure, that the valve closure member 30 come to a closed position, rather than remaining open. For this reason, the present invention includes several failsafe aspects.

The first failsafe aspect of the present invention is best shown in FIG. 2. In the embodiment of the invention shown in FIG. 2 the piston 60 is shown as one integral piece. The piston 60 has a first seal 140, a second seal 150, and a third seal 160. The seals 140, 150, 160 restrict fluid from flowing around the outside of piston 60 through cylinder 70. In this manner, fluid from the control pressure source that accumulates in chamber 170 on the upper end 61 of piston 60 is restricted from flowing into chamber 180 at the lower end 62 of piston 60 where fluid from the balance pressure source accumulates. Again, piston 60 is exposed to the bore 20 at opening 80 in cylinder 70 so that mechanical connection may be made between piston 60 and flow tube 40. Opening 80 is positioned between second seal 150 and third seal 160. There is also shown a failsafe passageway 130 which is in fluid communication with balance pressure line 190 and a portion of piston 60 between first seal 140 and third seal 160.

With this particular configuration, if second seal 150 fails, then fluid from bore 20 travels past second seal 150 through balance pressure line 190 and into failsafe passageway 130 and exerts equal and opposite forces on first and third seals 140 and 160. Furthermore, fluid from bore 20 travels directly to third seal 160 and exerts an upward force on third seal 160, thereby exerting a net upward force on piston 60. By decreasing the control pressure $P_c$ that acts on piston 60 at upper end 61, the piston 60 will move upward, causing valve closure member 30 to close as previously described.

If third seal 160, as shown in FIG. 2, were to fail, then fluid from bore 20 would travel past third seal 160 and into failsafe passageway 130, into balance line 190 thereby exerting an upward force on piston 60 at lower end 62 by virtue of second seal 150. Furthermore, fluid from bore 20 would travel past third seal 160 and exert an upward force on first seal 140, thereby exerting a net upward force on piston 60 thereby allowing valve closure member 30 to close when control pressure $P_c$ is decreased as previously described.

If first seal 140 were to fail, then fluid from control pressure line 200 would travel past first seal 140 and act equally and oppositely on second and third seals 160 and 150, as would fluid from balance pressure line 190. As such, the net forces on piston 60 due to control pressure $P_c$ and balance pressure $P_b$ would be zero and the spring 90 (FIGS. 1 and 3D) would lift flow tube 40 thereby closing valve closure member 30.

If both first and third seals 140 and 160 were to fail, then fluid from bore 20 would flow into failsafe passageway 130, through balance line 190 and exert an upward force on second seal 150. Fluid from bore 20 would also exert a downward force on second seal 150 directly. Furthermore, fluid from balance line 190 would flow through failsafe passageway 130 and exert a downward force on second seal 150, as well as exerting an upward force on second seal 150 in the normal manner through balance line 190. Similarly, fluid from control line 200 would exert both upward and downward forces on second seal 150. As such, the net forces due to fluid pressure on piston 60 would be zero and spring 90 would lift the flow tube 40, closing valve closure member as previously described.

It is noted that instead of being in fluid communication with a portion of piston member 60 between first seal 140 and third seal 160, failsafe passageway 130 may be in fluid communication with a portion of piston member 60 between second seal 150 and third seal 160. In this embodiment (not shown), the mechanical connection (and thus the fluid communication to the bore 20) between piston 60 and flow tube 40 is preferably located between first seal 140 and third seal 160. Such embodiment is within the scope of this invention.

Figure 3C:
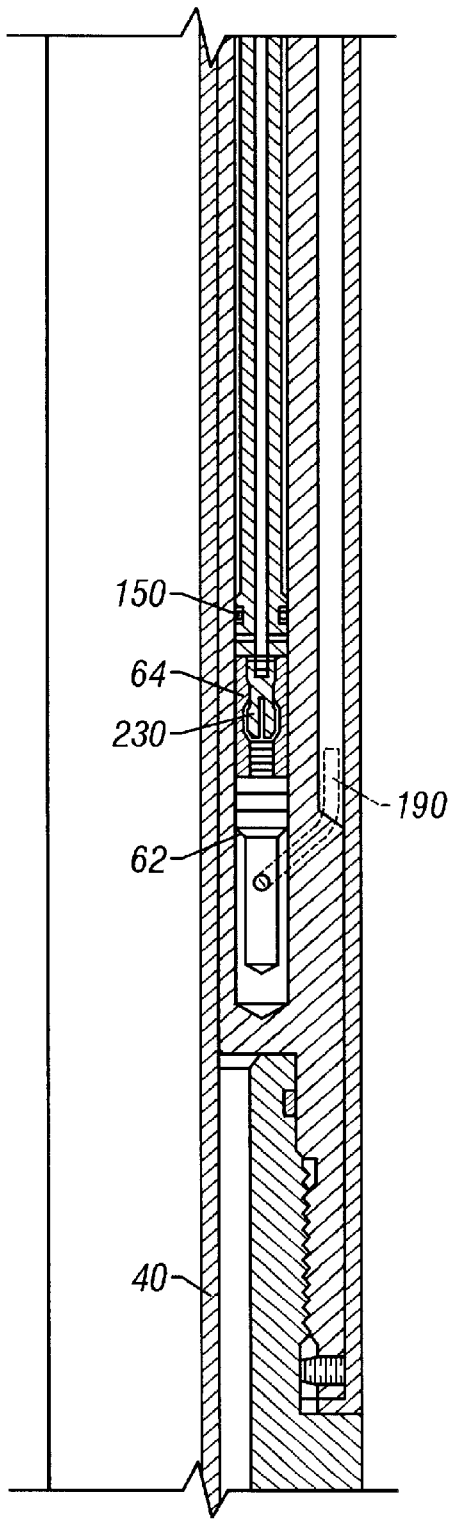
Figure 3D:
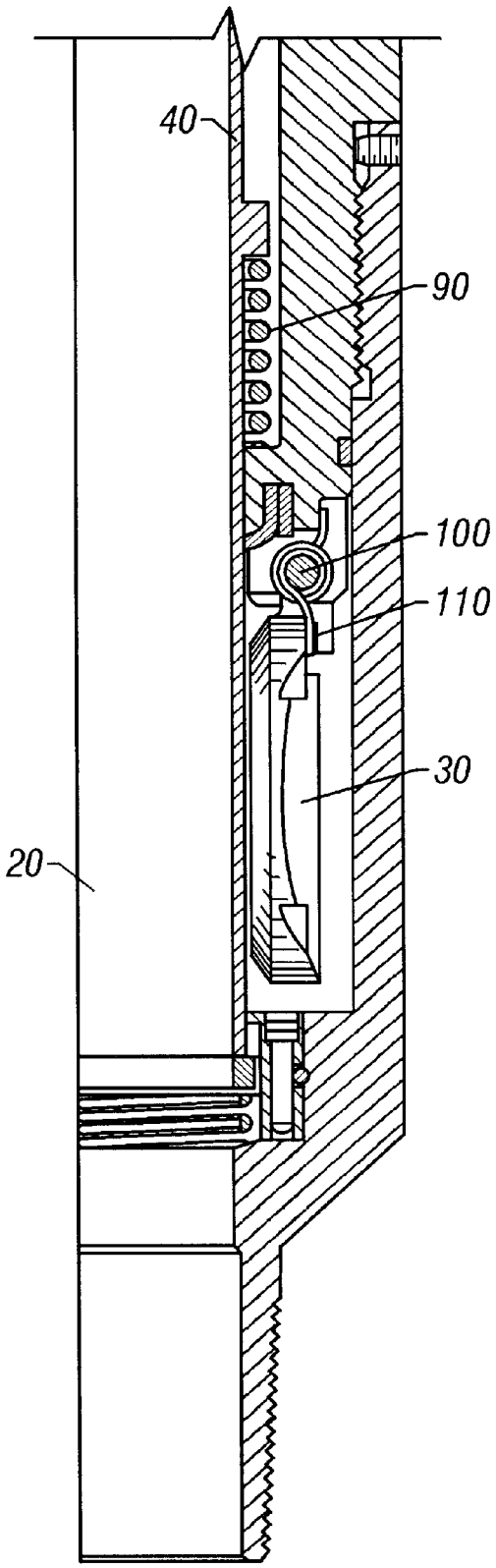

The next failsafe aspect of the present invention is the detachable or disengageable piston, which is best viewed in FIGS. 3A –3D. The operation of the detachable piston was described in detail in U.S. Pat. No. 4,660,646 to Blizzard, which is fully incorporated herein by reference, and reference should be made to that patent for a full understanding of its operation. In the particular embodiment shown in FIG. 3B, the piston and cylinder assembly preferably comprises a piston assembly 60', a cylinder 70 and a piston rod 210. The piston rod 210 has piston rod valve member 211 which is biased in an upward direction by spring 220. The piston assembly 60' is generally comprised of an upper piston member 63 and a lower, or disengageable, piston member 64 (FIG. 3C). There may also be a third piston member 65 which is in mechanical communication with the flow tube 40 as well as fluid communication with the bore 20 and is positioned between the upper piston member 63 and the lower piston member 64. Each piston member 63, 64, 65 is positioned in an end to end orientation to the next, and has an internal passageway 66 through which the piston rod 210 extends. Piston rod 210 is releasably attached to lower piston member 64 with coupling 230 (FIG. 3C). Even with the piston rod 210 within the internal passageway 66, fluid is capable of flowing through the internal passageway 66. Under certain conditions, as described in U.S. Pat. No. 4,660,646, where there is a first, second or third seal 140, 150, 160 failure, piston rod valve member 211 is unseated from upper piston member 63 and control fluid residing in chamber 170 is allowed to travel through the internal passageway 66 to the lower piston member 64, thereby equalizing the pressure forces on the piston assembly 60'. As such, either the force of spring 90 or the force exerted by balance pressure $P_b$ lifts piston assembly 60' and flow tube 40, thereby closing valve closure member 30. In other conditions, lower piston member 64 detaches from the rest of the piston assembly 60' by virtue of detachable connection 230, again causing the pressures on piston assembly 60' to be a net of zero and allowing subsurface safety valve 5 to fail in the closed position.

The present invention may incorporate the detachable piston arrangement just described with the failsafe arrangement shown in FIG. 2. FIGS. 3B–C show piston assembly 60' with a first set of seals 140, a second seal 150 and a third seal 160. As previously described with respect to FIG. 2, failsafe passageway 130 is provided, as seen in FIG. 3B, at a location between first seals 140 and 160. Failsafe passageway 130 is in fluid communication with balance pressure line 190 which is in turn in fluid communication with the lower end 62 of piston assembly 60'. Working in conjunction, the detachable piston and the failsafe passageway 130 provide a subsurface safety valve which, in the event of a failure, fails in the closed position. For example, when and if first seals 140 fail, fluid from balance line 190 as well as fluid from control line 200 enters internal passageway 66 and allows the fluid pressure on both ends 61, 62 of the piston assembly 60' to equalize, thereby allowing the spring 90 (FIG. 3D) to lift the flow tube 40 to close the valve closure member 30.

It should be noted that with a conventional detachable piston, under certain circumstances, proper operation depends upon spring 220 operating to lift piston rod 210 away from upper piston member 63 in order that the pressure on both ends 61, 62 of piston assembly 60 to equalize. The use of failsafe passageway 130 and third seal 160 eliminates the concern that spring 220 will malfunction, because as described with reference to FIG. 2, failsafe passageway 130 will allow the valve 5 to fail in the closed position. However, it should also be noted that proper function of the failsafe mechanism described with reference to FIG. 2 depends upon uninterrupted fluid flow through failsafe passageway 130. It may happen that debris becomes lodged in failsafe passageway 130 or some other similar malfunction occurs. The use of failsafe passageway 130 and third seal 160 in conjunction with the detachable piston 60' and piston rod 210 eliminates the worry that failsafe passageway 130 will become clogged with debris, because as just described, the detachable piston arrangement will allow the valve to fail in the closed position.

Figure 4:
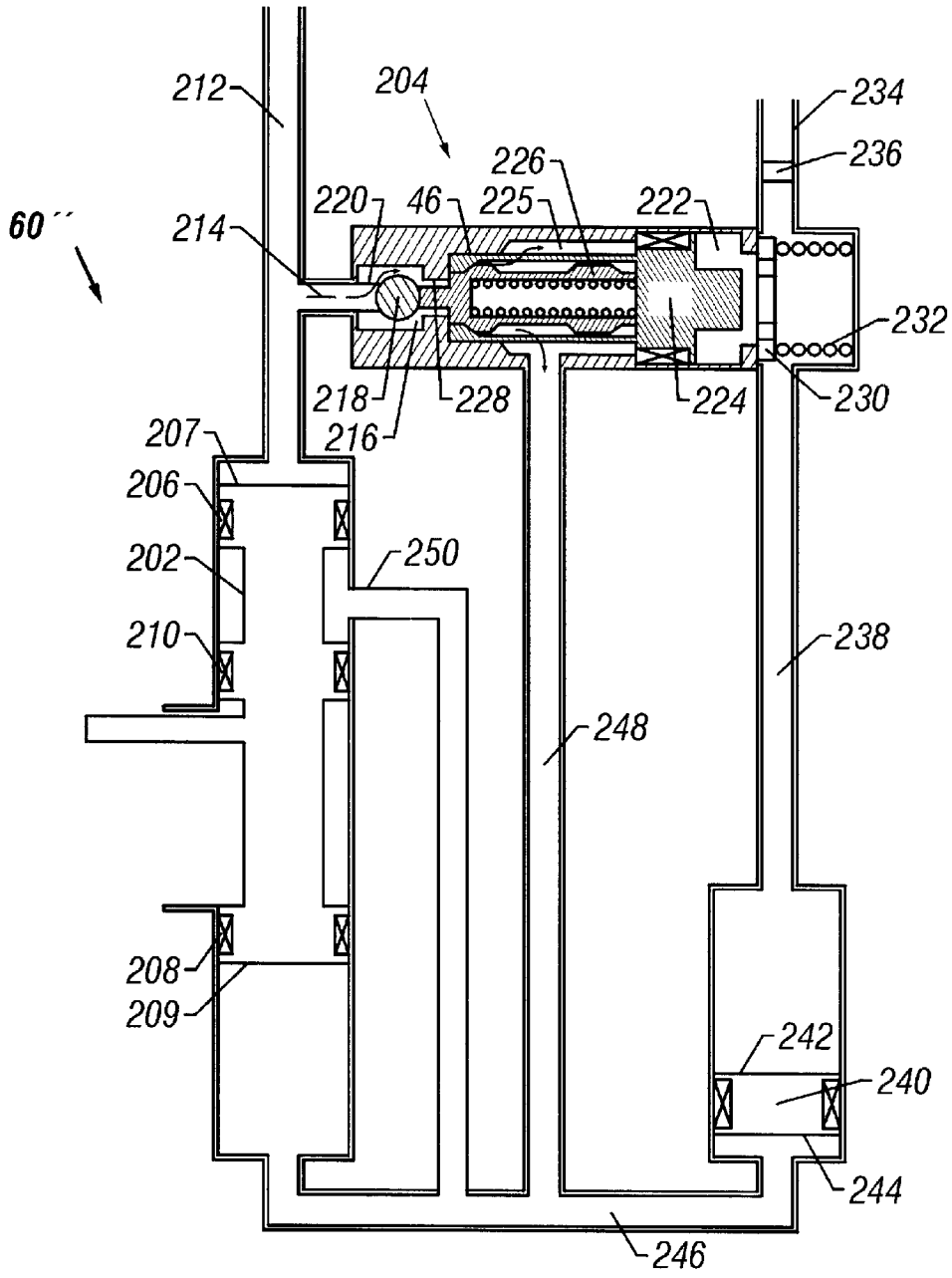
FIG. 4 illustrates a longitudinal cross-sectional view of a second embodiment of a piston and cylinder assembly with a disengageable piston member and a failsafe passageway.

Instead of the detachable piston assembly described above, this aspect of the present invention may include a disengageable piston assembly 60" having a piston member 202 in hydraulic communication with a disengageable piston member 204, such as the arrangement disclosed in U.S. Pat. No. 5,906,220 and shown in FIG. 4. Similar to the piston assembly 60', piston assembly 60" also functions to selectively cause the flow tube 40 to shift the valve closure member 30 to its closed position upon certain failure modes.

The piston member 202 may include a first seal 206 adjacent its upper end 207, a second seal 208 adjacent its opposite, or lower, end 209, and a third seal 210 between the first and second seals 206 and 208. A hydraulic control line 212 extends from an external pressure source (not shown) and is in fluid communication with the upper end 207 of the piston member 202 and with an inlet line 214, which establishes fluid communication between the hydraulic control line 212 and the disengageable piston member 204. The disengageable piston member 204 includes an initial chamber 216 which houses a ball or poppet 218 biased by a spring 220, and a second chamber 222 within which rides piston 224 having one or more collets 46. A third chamber 225 is formed between the initial chamber 216 and the second chamber 222. A secondary piston 226 is movably contained within the collets 46 and includes a tab or plunger 228 adapted to hold the ball 218 off its seat. A bumper plate 230 is also biased by a spring 232 for cooperable engagement with the piston 224. A balance pressure line 234 in fluid communication with the disengageable piston member 204 may extend to the surface or to the annulus, in the manner more fully described above. If the balance pressure line 234 is in fluid communication with the annulus, a filter 236 may be provided to prevent the flow of debris or contamination into the assembly 60".

A first conduit 238 may establish fluid communication between the disengageable piston member 204 and a barrier piston 240 having a first end 242 and a second end 244. A second conduit 246 established fluid communication between the second end 244 of the barrier piston 240 and the lower end 209 of the piston member 202. A third conduit 248 establishes fluid communication between the third chamber 225 of the disengageable piston member 204 and the second conduit 246. A fail safe passageway 250 may also be provided to establish fluid communication between the second conduit 246 and the portion of the piston member 202 between the first and third seals 206 and 210. The function of the fail safe passageway 250 is more fully described above in relation to the other embodiments, and the function of the disengageable piston assembly 60" is more fully described in U.S. Pat. No. 5,906,220.

With reference to FIG. 1, in accordance with the present invention, balance pressure $P_b$ may be provided in either of two ways. Both alternatives are shown in FIG. 1, though preferably only one alternative is used at a time. Balance line 190' extends to the surface and terminates at a conventional pressure source such as hydraulic pump 240. Alternatively balance line 190" is merely an opening to the annulus 250 surrounding the bore 20. In such a case, any of a variety of fluids may be injected into the annular area 250. The hydrostatic head of the fluid in the annulus 250 provides the pressure heretofore referred to as $P_b$. In this annulus-balanced embodiment, a filter 192 may be attached to the balance line 190" to prevent debris or other contamination in the annulus 250 from entering the valve 5. FIGS. 3A and 3B depict balance line 190 shown with both solid and phantom lines. The solid lines in FIG. 3A depict balance line 190" as extending into the annulus 250. Fluid from the annulus 250 is allowed to flow into balance line 190 to actuate the flow tube as previously described. The phantom line in FIG. 3A depicts the balance line 190' as extending to a hydraulic fluid source 240 at the surface, preferably nearby the wellhead.

It is to be understood that the invention is not limited to the exact details of construction, operation, exact materials or embodiments shown and described, as obvious modifications and equivalents will be apparent to one skilled in the art. For example, the various embodiments of the subsurface safety valve 5 of the present invention are shown disposed within a vertical, cased well bore. This should not be taken as a limitation. Instead, the invention is equally applicable to open hole and/or horizontal well bores. Accordingly, the invention is therefore to be limited only by the scope of the appended claims.

What is claimed is:

1. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions;

a piston assembly including a piston member in sliding relationship with a cylinder, the piston member in mechanical communication with the flow tube, the piston member having a first seal, a second seal, and a third seal, each seal sealing against the cylinder, and the third seal disposed between the first and second seals; and a failsafe passageway in fluid communication with a balance pressure line and a portion of the piston member between the first and second seals.

2. The subsurface safety valve of claim 1, wherein:

the failsafe passageway is in fluid communication with the portion of the piston member between the first and third seals; and the piston member is in mechanical communication with the flow tube between the second and third seals.

3. The subsurface safety valve of claim 1, wherein the balance pressure line is in fluid communication with a source of pressurized fluid at the earth's surface.

4. The subsurface safety valve of claim 1, wherein the piston member is a rod piston.

5. The subsurface safety valve of claim 1, wherein the piston assembly includes a disengageable piston member.

6. The subsurface safety valve of claim 5, wherein the disengageable piston member is in mechanical communication with the piston member.

7. The subsurface safety valve of claim 5, wherein the disengageable piston member is in hydraulic communication with the piston member.

8. The subsurface safety valve of claim 5, wherein the balance pressure line is in fluid communication with a source of pressurized fluid at the earth's surface.

9. The subsurface safety valve of claim 1, further including a spring member adapted to move the flow tube to allow the valve closure member to move to its closed position.

10. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions;

a piston assembly including a piston member in sliding realtionship with a cylinder, the piston member in mechanical communication with the flow tube, the piston member having a first seal, a second seal, and a third seal, each seal sealing against the cylinder, and the third seal disposed between the first and second seals;

a failsafe passageway in fluid communication with a balance pressure line and a portion of the piston member between the second and third seals; and wherein the piston member is in mechanical communication with the flow tube between the first and third seals.

11. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions;

a piston assembly including a piston member in sliding relationship with a cylinder, the piston member in mechanical communication with the flow tube, the piston member having a first seal, a second seal, and a third seal, each seal sealing against the cylinder, and the third seal disposed between the first and second seals;

a failsafe passageway in fluid communication with a balance pressure line and a portion of the piston member between the first and second seals; and wherein the balance pressure line is in fluid communication with the annulus.

12. The subsurface safety valve of claim 11, wherein the balance pressure line includes a filter.

13. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions;

a piston assembly including a piston member in sliding relationship with a cylinder, the piston member in mechanical communication with the flow tube, the piston against the cylinder, and the third seal disposed between the first and second seals; and a failsafe passageway in fluid communication with a balance pressure line and a portion of the piston member between the first and second seals;

wherein the piston assembly includes a disengageable piston member; and the balance pressure line is in fluid communications with the annulus.

14. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions;

a piston assembly including a piston member in sliding relationship with a cylinder, the piston member in mechanical communication with the flow tube, the piston member having a first seal, a second seal, and a third seal, each seal sealing against the cylinder, and the third seal disposed between the first and second seals; and a failsafe passageway in fluid communication with a balance pressure line and a portion of the piston member between the first and second seals;

wherein a first end of the piston member is in fluid communication with a control pressure line and a second end of the piston member is in fluid communication with the balance pressure line.

15. A subsurface safety valve for controlling a fluid flow though a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions; and a piston assembly having a piston member and a disengageable piston member, the piston member being in fluid communication with a control pressure source and in mechanical communication with the flow tube, the disengageable piston member being adapted to cooperate with the piston member to selectively cause the flow tube to shift the valve closure member to its closed position, at least one of the piston member and disengageable member being in fluid communication with a balance pressure line, the balance pressure line being in fluid communication with the annulus.

16. The subsurface safety valve of claim 15, further including a spring member adapted to force the flow tube toward its first position.

17. The subsurface safety valve of claim 15, wherein the disengageable piston member is in mechanical communication with the piston member.

18. The subsurface safety valve of claim 15, wherein the disengageable piston member is in hydraulic communication with the piston member.

19. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions; and a piston assembly having a piston member and a disengageable piston member, the piston member being in fluid communication with a control pressure source and in mechanical communication with the flow tube, the disengageable piston member being adapted to cooperate with the piston member to selectively cause the flow tube to shift the valve closure member to its closed position, at least one of the piston member and disengageable member being in fluid communication with a balance pressure line, the balance pressure line being in fluid communication with the annulus; wherein the balance pressure line includes a filter.

20. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions; and a piston assembly having a piston member and a disengageable piston member, the piston member being in fluid communication with a control pressure source and in mechanical communication with the flow tube, the disengageable piston member being adapted to cooperate with the piston member to selectively cause the flow tube to shift the valve closure member to its closed position, at least one of the piston member and disengageable member being in fluid communication with a balance pressure line, the balance pressure line being in fluid communication with the annulus; wherein the piston assembly is a detachable piston assembly disposed within a cylinder and in mechanical communication with the flow tube, the piston assembly having a lower piston member and an upper piston member, one end of one of the upper and lower piston members being in fluid communication with the control pressure source, and one end of the other of the upper and lower position members being in fluid communication with the balance pressure line.

21. The subsurface safety valve of claim 20, wherein each of the upper and lower piston members includes an internal passageway, the valve further including a piston rod having a piston rod valve member, disposed within the internal passageways of the upper and lower piston members and being detachably connected to the lower piston member.

22. The subsurface safety valve of claim 20, further including a first seal disposed about the upper piston member, a second seal disposed about the lower piston member, a third seal disposed about the lower piston member at a location between the first and second seals, and a failsafe passageway in fluid communication with the balance pressure line and portions of the upper and lower pistons located between the first and third seals.

23. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions;

a piston assembly having a piston member and a disengageable piston member, the piston member being in fluid communication with a control pressure source and in mechanical communication with the flow tube, the disengageable piston member being adapted to cooperate with the piston member to selectively cause the flow tube to shift the valve closure member to its closed position, at least one of the piston member and disengageable member being in fluid communication with a balance pressure line, the balance pressure line being in fluid communication with the annulus; wherein the piston member includes a first seal, a second seal, and a third seal, the third seal disposed between the first and second seals; and a failsafe passageway in fluid communication with a balance pressure line and a portion of the piston member between the first and second seals.

24. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions; and a piston assembly having a piston member and a disengageable piston member, the piston member being in fluid communication with a control pressure source and in mechanical communication with the flow tube, the disengageable piston member being adapted to cooperate with the piston member to selectively cause the flow tube to shift the valve closure member to its closed position, at least one of the piston member and disengageable member being in fluid communication with a balance pressure line, the balance pressure line being in fluid communication with a source of pressurized fluid at the earth's surface; and a failsafe passageway to provide fluid communication between a balance line and a cylinder in which the piston member travels.

25. The subsurface safety valve of claim 24, further including a spring member adapted to move the flow tube to allow the valve closure member to move to its closed position.

26. The subsurface safety valve of claim 24, wherein the disengageable piston member is in mechanical communication with the piston member.

27. The subsurface safety valve of claim 24, wherein the disengageable piston member is in hydraulic communication with the piston member.

28. The subsurface safety valve of claim 24, wherein:

the piston member includes a first seal, a second seal, and a third seal, the third seal disposed between the first and second seals; and a failsafe passageway in fluid communication with a balance pressure line and a portion of the piston member between the first and second seals.

29. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions; and a piston assembly having a piston member and a disengageable piston member, the piston member being in fluid communication with a control pressure source and in mechanical communication with the flow tube, the disengageable piston member being adapted to cooperate with the piston member to selectively cause the flow tube to shift the valve closure member to its closed position, at least one of the piston member and disengageable member being in fluid communication with a balance pressure line, the balance pressure line being in fluid communication with a source of pressurized fluid at the earth's surface; wherein the piston assembly is a detachable piston assembly disposed within a cylinder and in mechanical communication with the flow tube, the piston assembly having a lower piston member and an upper piston member, one end of one of the upper and lower piston members being in fluid communication with the control pressure source, and one end of the other of the upper and lower piston members being in fluid communication with the balance pressure line.

30. The subsurface safety valve of claim 29, wherein each of the upper and lower piston members includes an internal passageway, the valve further including a piston rod having a piston rod valve member, disposed within the internal passageways of the upper and lower piston members and being detachably connected to the lower piston member.

31. The subsurface safety valve of claim 29, further including a first seal disposed about the upper piston member, a second seal disposed about the lower piston member, a third seal disposed about the lower piston member at a location between the first and second seals, and a failsafe passageway in fluid communication with the balance pressure line and portions of the upper and lower pistons located between the first and third seals.

* * * * *